United States Patent [19]

Durrer et al.

[11] Patent Number: 4,802,585

[45] Date of Patent: Feb. 7, 1989

[54] PICTURE HOLDER

[75] Inventors: Rudolph Durrer; Hilmar Priessner, both of Zürich; Eric Bach, Taufkirchen, all of Fed. Rep. of Germany

[73] Assignee: Peter Fuchs GmbH Druckservice, Fed. Rep. of Germany

[21] Appl. No.: 888,749

[22] Filed: Jul. 22, 1986

[30] Foreign Application Priority Data

Jul. 22, 1985 [DE] Fed. Rep. of Germany ..... 8521119

[51] Int. Cl.[4] ..... B65D 85/48

[52] U.S. Cl. ..... 206/449; 206/455; 383/38

[58] Field of Search ..... 383/38, 39, 40; 206/455, 456, 449

[56] References Cited

U.S. PATENT DOCUMENTS

| | | | |
|---|---|---|---|
| 1,688,699 | 10/1928 | Gardner, Jr. | 383/40 |
| 2,119,895 | 6/1938 | Sutton | 383/40 |
| 2,710,638 | 6/1955 | Ford | 383/40 |
| 2,832,389 | 4/1958 | Smith | 383/39 |
| 3,459,361 | 8/1969 | Matton | 383/40 |
| 4,533,048 | 8/1985 | Ozeki | 206/455 |

FOREIGN PATENT DOCUMENTS

| | | | |
|---|---|---|---|
| 2201381 | 7/1979 | Fed. Rep. of Germany | 200/455 |
| 476606 | 7/1966 | Switzerland | 206/455 |
| 1492571 | 11/1977 | United Kingdom | 200/455 |

*Primary Examiner*—Joseph Man-Fu Moy
*Attorney, Agent, or Firm*—Ostrolenk, Faber, Gerb & Soffen

[57] ABSTRACT

A passepartout for articles, such as photographs, films, pictures or the like, comprises a closable pocket receiving the articles. The passepartout is formed by two layers (2, 3) of a transparent plastic material which are welded together on three (1*a,* 1*b,* 1*c*) of four outer edges for forming an envelope (1). The envelope is divided by at least one further weld seam (4*a,* 4*b*) extending parallel to an outer edge into a plurality of pockets (4, 5, 6) and the object (7) is disposed in a first (4) of said pockets while inscription strips (8, 9) are disposed in the other pocket or pockets (5, 6).

5 Claims, 2 Drawing Sheets

PICTURE HOLDER

The invention relates to a passepartout for objects such as photographs, films, pictures or the like, having a closable pocket receiving the objects Such passepartouts are for example used for dispatching slides on approval or the like but can also be used for keeping films or the like in a file or archive. The objects arranged in such passepartouts are preferably sheet-shaped articles A passepartout of the aforementioned type is known which consists of a cardboard sheet which is coated on one side with a self-adhesive foil and foldable along a centre line, window openings each corresponding to the size of the object being disposed in the two halves. The two halves of the cardboard sheet are folded over onto each other with the self-adhesive side and between these two halves the object, for example a film, is disposed. This passepartout is very difficult and time-consuming to handle because the article, for example a film, must be arranged very exactly over the window openings and a subsequent displacement on the basis of the self-adhesive properties of the cardboard sheet is hardly possible.

Furthermore, the object is disposed unprotected in this passepartout and consequently there is an enhanced risk of damage, for example to films.

The problem underlying the invention is to provide a passepartout of the type mentioned at the beginning which guarantees improved protection of the objects and is easier to handle.

This problem is solved by the features set forth in the characterizing clause of claim 1.

Further embodiments and developments of the invention are set forth in the subsidiary claims.

With the configuration of the passepartout according to the invention the objects, in particular films, pictures or other sheet-shaped products, are reliably protected in the passepartout from external influences and can be inserted in simple manner into the at least one pocket.

Preferably, closure means are provided which close at least the pocket receiving the object but possibly also the pockets which can be used to accommodate inscription strips.

If a check on the removal of the object, for example a film, from the passepartout is desired or securing against such removal the open side of the envelope forming the passepartout can be sealed with a further weld seam.

When the objects to be received by the passepartout are slides or the like which are observed by the look-through method it may be desirable for at least one of the layers of the envelope to have a non-transparent material layer surrounding the object in the region of the first pocket because this prevents undesirable light passage at the edges of the film.

According to an advantageous further development of the invention the insertion of the object into the first pocket is facilitated in that in the region of said pocket guide means for the object are disposed. Said guide means may for example be formed by weld seams extending over short distances between the two layers, and in particular the short weld seams adjacent the open edges of the envelope may widen in funnel manner outwardly to facilitate insertion of the film or the like.

An example of embodiment will be explained in detail with the aid of the drawings.

Figure 1:
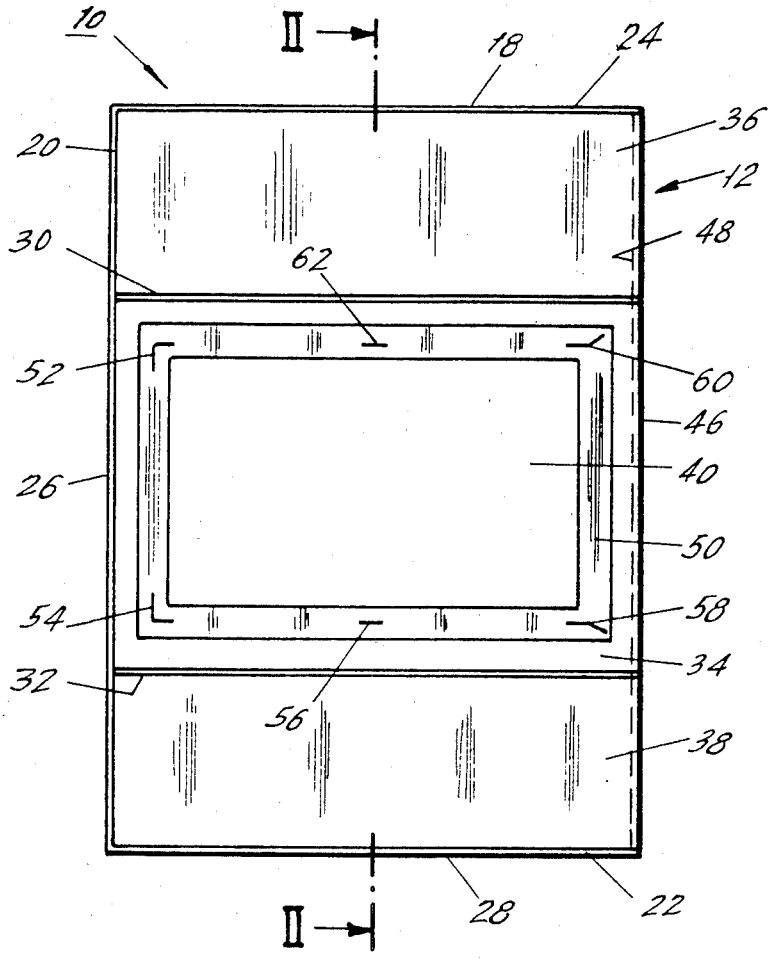
FIG. 1 is a plan view of an embodiment of the passepartout.
Figure 2:
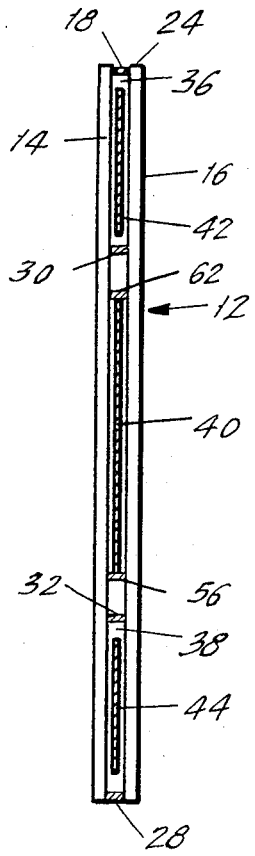
FIG. 2 is a sectional view along the line II—II of FIG. 1, the spacing between the material layers and thus also the thickness of the weld seams connecting the material layers being shown exaggerated.

In the embodiment of the passepartout according to FIGS. 1 and 2 an envelope 1 is formed in that two layers 2, 3 of transparent plastic material are placed on each other in the manner shown in FIG. 2 and fused together via weld seams 1*a*, 1*b* and 1*c* at three outer edges. The weld seam 1*b* may be dispensed with if a material piece of twice the size is folded back on itself, the edge at 1*b*then being formed by a fold.

The envelope 1 thus formed is then divided by further weld seams, two seams 4*a*, 4*b* in the example of embodiment illustrated, into three pockets 4, 5, 6, the centre pocket 4 serving to receive a film 7 or a similar flat material.

The two other pockets 5, 6 may be used to insert respective inscription strips as apparent from FIG. 2.

Of course, it is equally possible to omit one of the pockets 5, 6 or even both of them giving only an envelope for a film 7. The pockets provide however a preferred possibility of arranging inscription strips so that not only the film but also such inscription strips themselves are protected from damage and alteration.

After insertion of the film 7 and possibly of the inscription strips 8, 9 the remaining outer edge 1*d* may be sealed by a further weld seam so that the film and/or the inscription strips cannot be removed without damaging the envelope.

One or both layers 2, 3 of the envelope may be covered in the region of the pocket 4 partially by a non-transparent material layer, for example a printed-on black material layer, as illustrated by the border 10. The film or object 7 then lies within this border, its outer edges being covered by said border 10.

To guide the film or other object in the pocket 1 guide means may preferably be arranged in said pocket which in the embodiment illustrated are formed by weld seams 11*a*to 11*f* extending over short distances. The weld seams 11*e* and 11*d* adjacent the open edge 1*d* are preferably widened outwardly in funnel shape whilst the short weld seams 11*a* and 11*b* arranged on the opposite side of the envelope may have an angled form.

It is pointed out that in FIG. 2 for clarity the weld seams are shown lying between the material layers 2, 3. In practice, however, in these regions the layers 2, 3 bear tightly on each other and are fused together by heat.

The embodiment illustrated of the passepartout can be made in any desired sizes and it is also possible to make passepartouts of the same size for receiving different film sizes by simply adapting the cover 10 and the weld seams 11*a* to 11*f* forming the guide means appropriately to the different film sizes.

In the above description films were referred to as preferably representing the objects 7. The articles 7 may however be formed by any flat articles or articles with small thickness dimensions.

We claim:

1. A holder for pictures, or the like, comprising:

two generally rectangular layers of a transparent plastic material welded together at three of four outer edges to form an envelope open at one of the edges; at least on further weld seam between the layers and extending parallel to one of the edges intersecting the open edge for dividing the envelope internally, into a plurality of pockets; guide means in one of the pockets, comprising guide means weld seams between the two layers, said guide means weld seams being shorter in length than the distance between the open edge and the opposite closed edge of the one pocket, said guide means weld seams being placed at positions within said pocket for guiding installation of a picture, or the like, through the one open edge and into a predetermined region of the one pocket defined by the guide means weld seams.

2. A picture holder as set forth in claim 1, further comprising closure means for closing the open edge at at least the one pocket after insertion of a picture, or the like therein.

3. A picture holding as set forth in claim 2, wherein the closure means includes a weld seam.

4. A picture holder as set forth in claim 3, wherein at least a portion of one of the layers is non-transparent at the one pocket in the region thereof at which the guide means support a picture, or the like.

5. A picture holder as set forth in claim 4, wherein the guide means weld seams located toward the open edge are widened outwardly in a funnel-like manner for guiding a picture, or the like, into the pocket.

* * * * *